United States Patent [19]

Kishi

[11] Patent Number: 4,529,063

[45] Date of Patent: Jul. 16, 1985

[54] ELEVATING APPARATUS

[75] Inventor: Mitsuhiro Kishi, Ashikaga, Japan

[73] Assignee: Kabushiki Kaisha Hikoma Seisakusho, Tochigi, Japan

[21] Appl. No.: 515,385

[22] Filed: Jul. 18, 1983

[30] Foreign Application Priority Data

Jul. 24, 1982 [JP] Japan ..... 57-129201

[51] Int. Cl.[3] ..... B66B 9/20

[52] U.S. Cl. ..... 187/9 E; 187/9 R; 182/41; 182/141; 52/121

[58] Field of Search ..... 187/9 R, 9 E, 17, 1 A, 187/95; 254/364; 182/40, 41, 63, 141; 52/111, 121

[56] References Cited

U.S. PATENT DOCUMENTS

| | | | |
|---|---|---|---|
| 2,166,479 | 7/1939 | Ruddock | 254/364 |
| 3,033,529 | 5/1962 | Pierrat | 52/111 |
| 3,752,261 | 8/1973 | Bushnell | 182/17 |
| 4,083,510 | 4/1978 | Gomez | 242/107 |
| 4,427,093 | 1/1984 | Wehmeyer et al. | 182/141 |

*Primary Examiner*—Joseph J. Rolla
*Assistant Examiner*—Nils E. Pedersen
*Attorney, Agent, or Firm*—Koda and Androlia

[57] ABSTRACT

An elevating apparatus comprises a substantially horizontal base, a longitudinally extensible mast mechanism mounted vertically on the base, a wire guide mechanism mounted on the mast mechanism and having a pair of pulleys rotatable synchronously in opposite directions, a work platform supported on the wire guide mechanism, and a pair of wires extending across the mast mechanism and having one ends fixed to the base respectively at spaced positions thereon, the wires being wound around the pulleys, respectively. The elevating apparatus also includes a pair of wire tensioners mounted on the base respectively at spaced positions thereon for longitudinally tensioning the wires, respectively, in opposite directions.

10 Claims, 6 Drawing Figures

ELEVATING APPARATUS

BACKGROUND OF THE INVENTION

The present invention relates to an elevating apparatus for lifting workers, materials and/or pieces of equipment to an elevated position to provide a safe and stable work platform for various operations at desired elevation on bridges, multistory buildings, or other high constructions.

Recent years have found various high constructions such as bridges, multistory buildings, or other structures. It is frequently necessary to lift workers or materials from the ground to an elevated position on such high constructions, or provide a safe work platform at desired elevation for various operations such as tightening of bolts or painting on the underside of a bridge or applying a floor material to a higher floor in a building. Various lifting or elevating apparatus have been developed and used. One common problem with the known arrangements is that the work platform as it is lifted to an elevated position is unstable and liable to swing due to winds, making the workers feel insecure and preventing them from doing desired works. The work platform can be supported stably against unwanted wobbling movements by a rugged and heavy mechanism for lifting the platform or an additional mechanism for reinforcing the platform. However, these mechanisms are complex in construction, result in an additional cost, and cannot be transported easily. There is known a manual support arrangement in which a plurality of ropes ar attached to an elongated ladder-like mechanism supporting thereon a work platform and manually pulled in opposite directions to render the platform stable against wobbling motions. Although the ladder-like platform supporting mechanism is relatively lightweight and thin in construction, several workers are required just for pulling and gripping the ropes. Accordingly, the known manual support apparatus has failed to find widespread general use.

SUMMARY OF THE INVENTION

It is an object of the present invention to provide an elevating apparatus for lifting a work platform and supporting the same stably against wobbling movements due to winds or other external forces.

According to the present invention, a longitudinally extensible mast mechanism is vertically mounted on a horizontal mobile base and supports thereon a work platform with a wire guide mechanism interposed therebetween. The wire guide mechanism has a pair of pulleys rotatable synchronously in opposite directions, and a pair of wires extend across the mast mechanism and have one ends fixed to the base respectively at spaced positions thereon, the wires being wound around the pulleys, respectively. A pair of wire tensioners may be mounted on the base respectively at spaced positions thereon for longitudinally tensioning the wires in opposite directions.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

in FIG. 1;

DESCRIPTION OF THE PREFERRED EMBODIMENT

Figure 1:
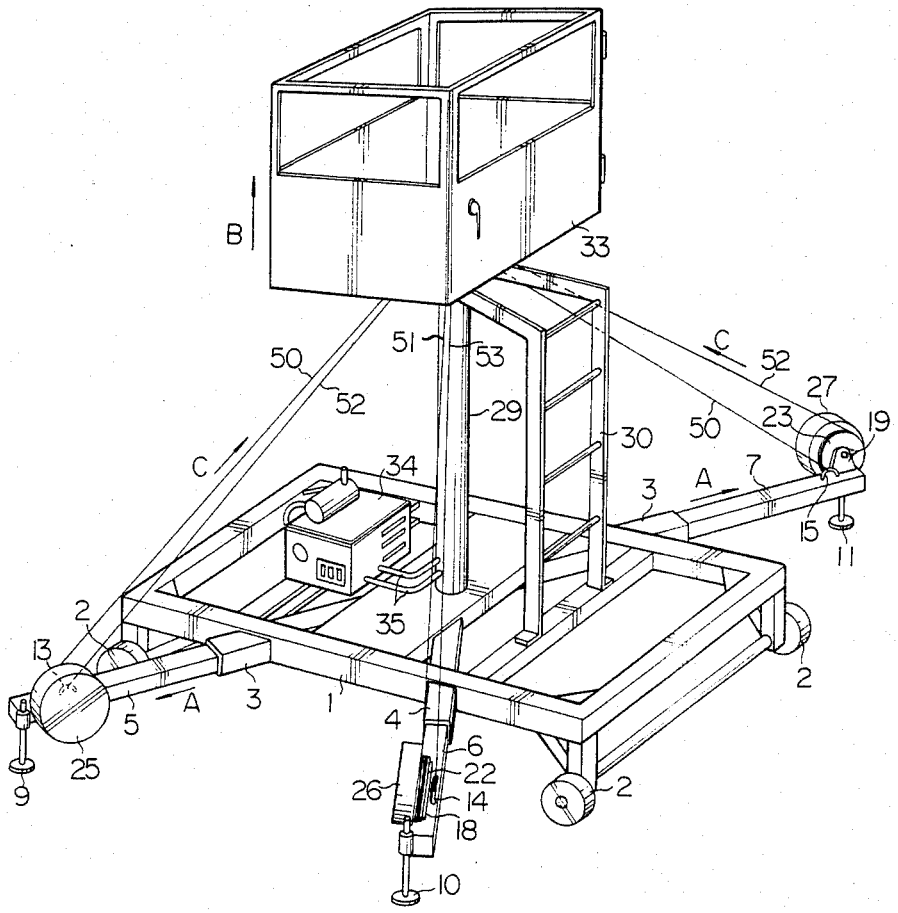
FIG. 1 is a perspective view of an elevating apparatus according to the present invention.
Figure 2:
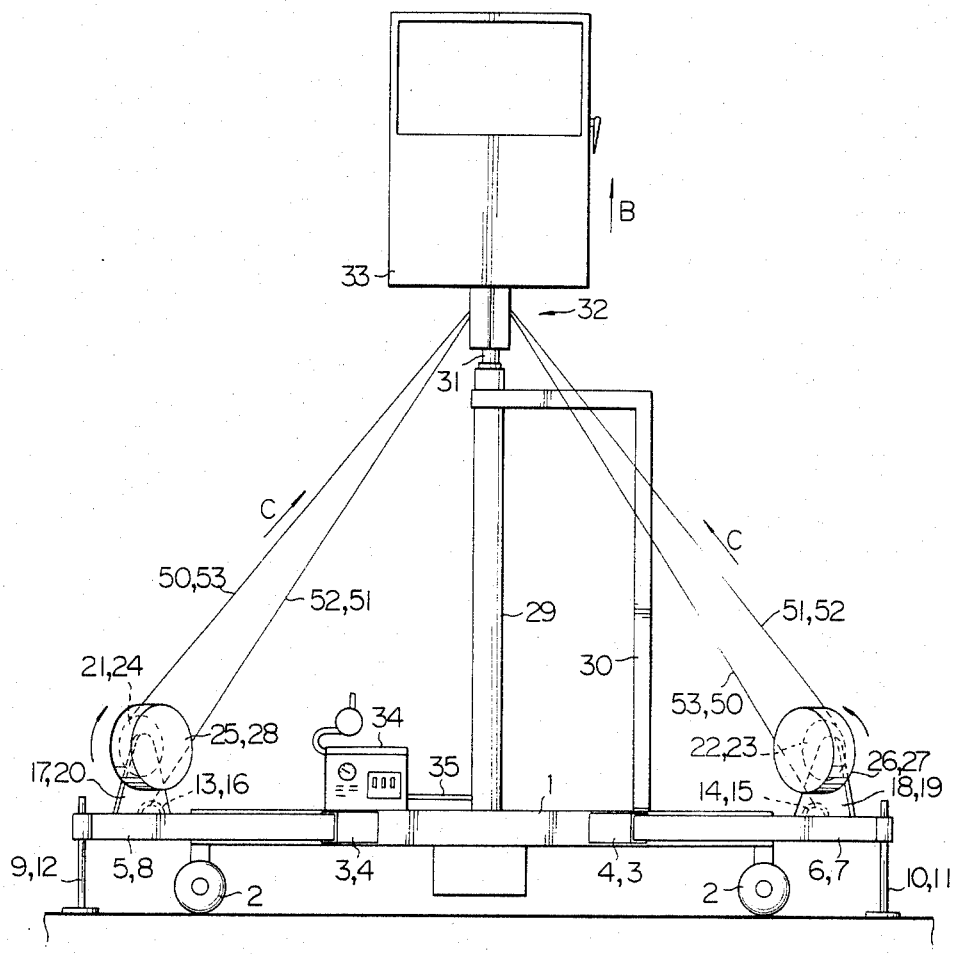
FIG. 2 is a front elevational view of the elevating apparatus shown.
Figure 3:
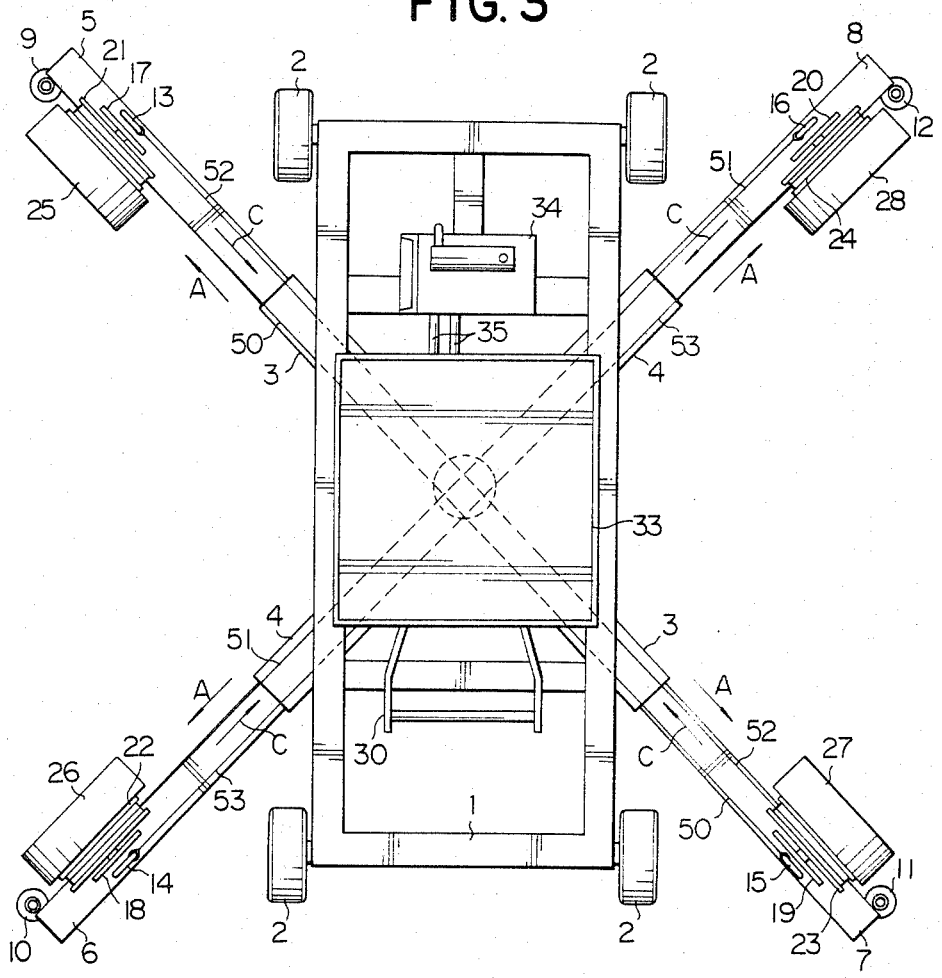
FIG. 3 is a plan view of the elevating apparatus illustrated in FIG. 1.

As shown in FIGS. 1 through 3, an elevating apparatus according to the present invention has a ladder-shaped rectangular frame or base 1 having four wheels 2 rotatably mounted on its corners. The base 1 can thus be moved by the wheels 2 substantially horizontally. The base 1 includes a pair of horizontal pipes 3, 4 each having a substantially rectangular cross section, the pipes 3, 4 crossing each other in the shape of an X and extending at an angle of 45° to a longitudinal direction of the base 1. The joint of the pipes 3, 4 is located substantially centrally of the base 1. Four slidable legs 5, 6, 7 and 8 are telescopically fitted in the open end portions of the pipes 3, 4. The slidable legs 5, 6, 7 and 8 have vertically adjustable outriggers 9, 10, 11 and 12, respectively.

The slidable legs 5, 6, 7 and 8 also have wire attachments 13, 14, 15 and 16, respectively, having substantially inverted U-shaped configurations and secured to upper surfaces thereof ajacent to their distal ends. The slidable legs 5, 6, 7 and 8 also have supports 17, 18, 19 and 20, respectively, adjacent to the wire attachments 13, 14, 15 and 16. Drums 21, 22, 23 and 24 are rotatably mounted on the supports 17, 18, 19 and 20, respectively. Spring casings 25, 26, 27 and 28 are also mounted on the supports 17, 18, 19 and 20, respectively.

Figure 4:
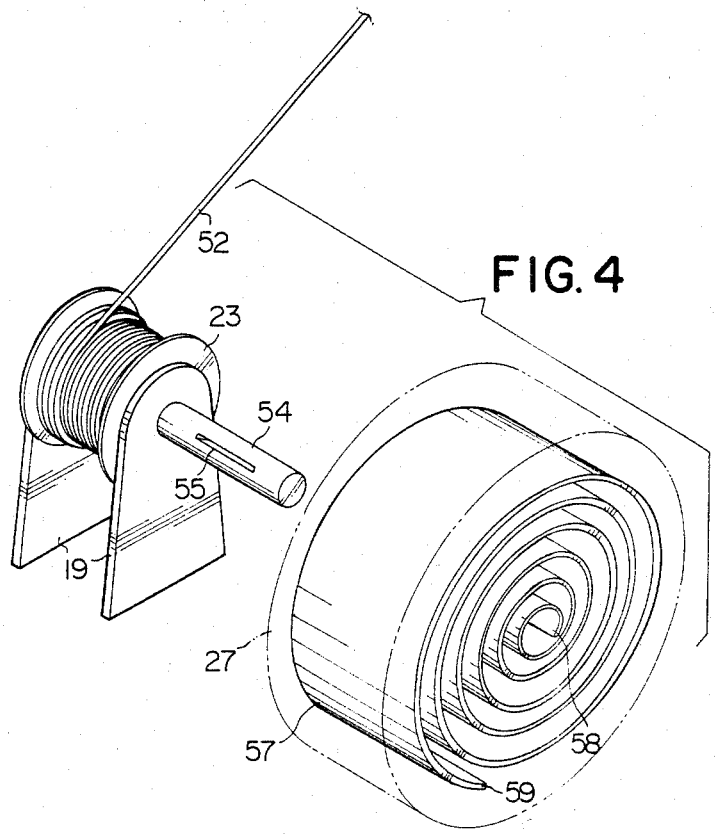
FIG. 4 is an enlarged exploded perspective view of a wire tensioner.

The drum 23 and the spring casing 27 will be described in greater detail with reference to FIG. 4. The other drums and the spring casings are of the same construction and will not be described. The support 19 is composed of a pair of legs with a shaft 54 rotatably supported thereby and extending transversely therethrough. The drum 23 is fixedly mounted on the shaft 54 and disposed between the support legs. The shaft 54 has a longitudinal slot 55. The spring casing 27 comprises a hollow cylindrical construction housing therein a spiral spring 57 having an inner end 58 fitted in the slot 55 in the shaft 54 and an outer end 59 fixed to an inner wall surface of the spring casing 27. Thus, the drum 23 is normally urged under the force of the spring 57 to rotate in one direction about the axis of the shaft 54.

A mast 29 is vertically disposed on a center of the base 1. A ladder 30 of an inverted L-shaped profile is secured to and extends between an upper end of the mast 29 and the base 1. The mast 29 comprises a hollow cylinder with a rod 31 extensibly disposed in the mast 29, the rod 31 being actuatable by a hydraulic cylinder (not shown).

A wire guide mechanism 32 is mounted on the top of the rod 31, and a work platform 33 is secured to an upper surface of the wire guide mechanism 32. The work platform 33 serves to carry workers, materials and various pieces of equipment. A hydraulic pressure generator 34 composed of an engine and operating oil is mounted on an upper surface of the base 1. The hydraulic pressure generator 34 is connected by a hydraulic hose 35 to the hydraulic cylinder accommodated in the mast 29.

Figure 5:
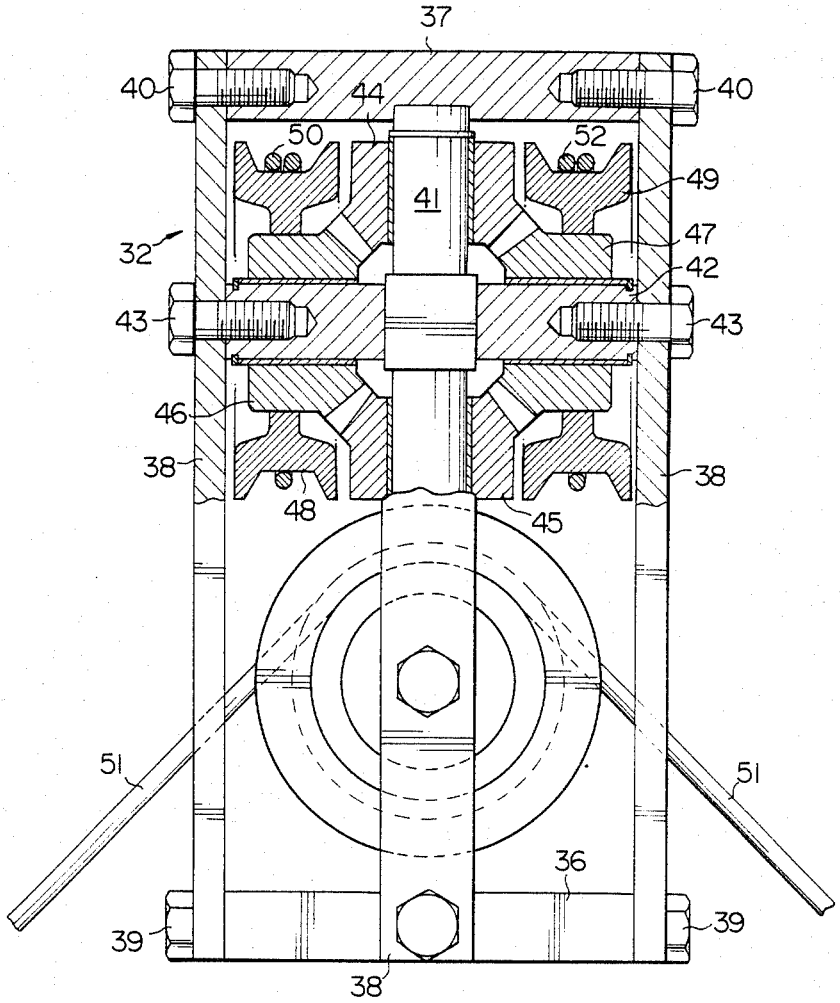
FIG. 5 is an enlarged side elevational view, with parts in cross section, of a wire guide mechanism.
Figure 6:
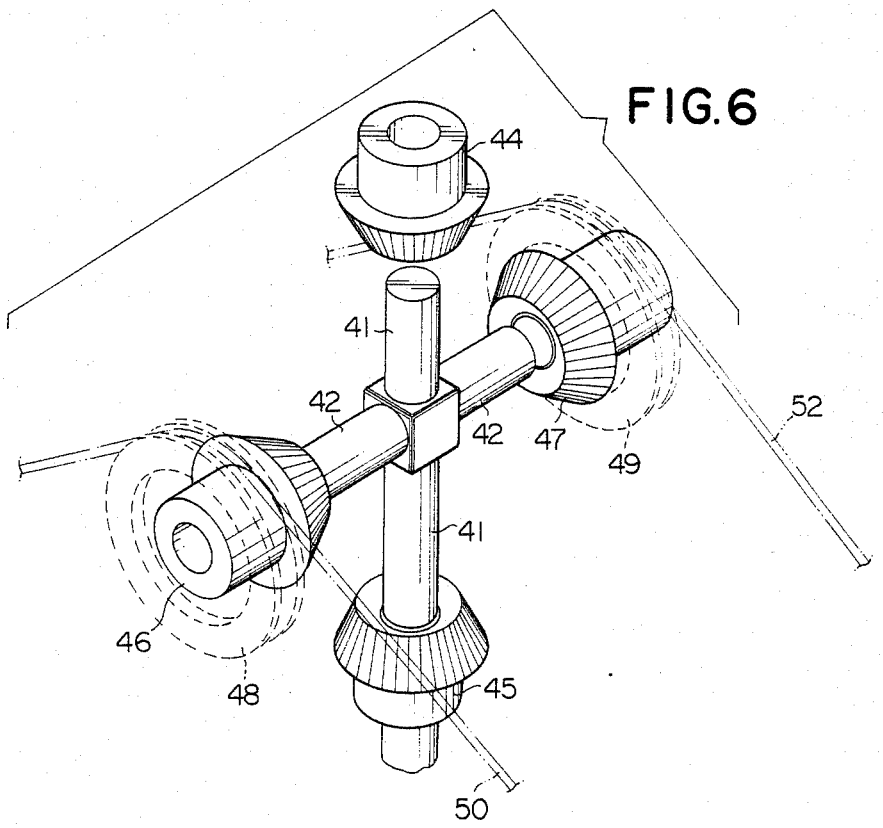
FIG. 6 is an exploded perspective view of the wire guide mechanism shown in FIG. 5.

FIGS. 5 and 6 illustrate the wire guide mechanism 32 in greater detail. The wire guide mechanism 32 comprises a casing composed of a bottom plate 36 secured to the rod 31, a top plate 37 extending parallel to the bottom plate 36 in spaced relation and secured to the work platform 33, and a plurality of narrow side plates 38, 38 extending vertically between the bottom and top plates 36, 37 in parallel relation and fastened to central side edges of the bottom and top plates 36, 37 by means of bolts 39, 40. A central vertical shaft 41 extends centrally between and is fixed to the bottom and top plates 36, 37. A pair of horizontal shafts 42 (only one shown) is secured to the vertical shaft 41. An upper one of the horizontal shafts is vertically positioned at a distance equal to $\frac{1}{4}$ of the length of the vertical shaft 41 from the top plate 37, while the lower horizontal shaft is vertically positioned at a distance equal to $\frac{1}{4}$ of the length of the vertical shaft 41 from the bottom plate 36. The horizontal shafts 42 extend in crisscross relation between opposite side plates 38, 38 and secured thereto by bolts 43, 43. A pair of upper and lower intermediate bevel gears 44, 45 is rotatably mounted on the vertical shaft 41 one on each side of the upper horizontal shaft 42. A pair of lateral drive bevel gears 46, 47 is also rotatably mounted on the upper horizontal shaft 42 one on each side of the vertical shaft 41 and held in mesh with both the upper and lower intermediate bevel gears 44, 45. The drive bevel gears 46, 47 are thus rotatable about the horizontal shaft 42 at the same speed in opposite directions in synchronism with each other. A pair of pulleys 48, 49 is fixedly mounted on the drive gears 46, 47, respectively. Although not shown in FIG. 5, another pair of intermediate bevel gears is also rotatably mounted on the vertical shaft 41 one each side of the lower horizontal shaft, and another pair of drive bevel gears is also rotatably mounted on the lower horizontal shaft one on eac side of the vertical shaft 41 in mesh with the drive bevel gears. Another pair of pulleys is fixed to the drive gears. A pair of wires 50, 52 is wound as one or more turns around the pulleys 48, 49, respectively, and have one ends fastened to the wire attachments 15, 13, respectively, and other ends wound around the drums 21, 23. Therefore, the wires 50, 52 extend across the wire guide mechanism 32 toward opposite positions on the legs 5, 7. Another pair of wires 51, 53 is wound as one or more turns around the pulleys on the lower horizontal shaft, respectively, and have one ends fastened to the wire attachments 16, 14, respectively, and other ends wound around the drums 22, 24. Therefore, the wires 51, 53 extend across the wire guide mechanism 32 toward opposite positions on the legs 6, 8.

Operation of the elevating apparatus thus constructed is as follows:

The elevating apparatus is moved by the wheels 2 to a desired location where a job is to be done at an elevated position, such as below a bridge, on a building floor, or below a utility pole. After the elevating apparatus has been stopped in such a desired position, the legs 5–8 are pulled out of the pipe 3, 4 into a larger X shape, and then the outriggers 9–12 are lowered against the ground or floor to prevent the base 1 from being moved around. Then, the engine in the hydraulic pressure generator 34 is started to supply oil under pressure through the hose 35 into the hydraulic cylinder in the mast 29 for thereby pushing the rod 31 upwardly out of the upper end of the mast 29. The upward movement of the rod 31 causes the wire guide mechanism 32 and the work platform 33 to move upwardly in the direction of the arrow B (FIGS. 1 and 2). Therefore, workers and materials which have been carried on the work platform 33 are lifted to an elevated position. As the wire guide mechanism 32 is raised, the wires 50–53 with their one ends attached to the legs 5–8 are unwound from the drums 21–24 in the directions of the arrows C against the bias of the spiral springs 57. During this time, the pulleys 48, 49 are rotated by the wires. Since the drive gears 46, 47 are held in mesh with the intermediate gears 44, 45, the drive gears 46, 47 and hence the pulleys 48, 49 are rotated at the same speed in opposite directions. This enables the wires 50–53 to be reeled off the drums 21–24 in equal lengths while under equal tensions imposed by the spiral springs 57. As shown in FIG. 2, the wires 50–53 and the base 1 substantially form isosceles triangles. The wire guide mechanism 32 is now resiliently pulled by the wires 50–53 in four angularly spaced directions so as to be guided to move upwardly against lateral wobbling movements. Therefore, the work platform 33 can be lifted stably while being supported by the wires 50–53 as they are tensioned resiliently by the spiral springs 57.

When the platform 33 is to be lowered, the oil under pressure is discharged from the hydraulic cylinder in the mast 29 to allow the rod 31 to be retracted downwardly into the mast 29. The wire guide mechanism 32 and the work platform 33 are then allowed to move downwardly. At the same time, the wires 50–53 are progressively wound around the drums 21–24 which are rotated under the bias of the spiral springs 57. The pulleys 48, 49 are rotated at the same speed in opposite directions by the wires 50–53. Accordingly, the wires 50–53 are wound around the drums 21–24, respectively, at the same rate to keep the wire guide mechanism 32 under equal tensions in the four lateral directions. The work platform 33 is now moved downwardly without wobbling while being laterally supported by the wires 50–53, so that it can be lowered stably.

With the foregoing arrangement, the work platform 33 can be maintained by the wires 50–53 stably against any unwanted laterally movements. The workers on the work platform 33 can do accurate jobs without feeling insecure.

Although a certain preferred embodiment has been shown and described, it should be understood that many changes and modifications may be made therein without departing from the scope of the appended claims.

What is claimed is:

1. An elevating apparatus comprising:

(a) a substantially horizontal base, said base comprising a pair of horizontal pipes extending in alignment with each other and a pair of legs telescopically fitted in said pipes;

(b) a longitudinally extensible mast mechanism mounted vertically on said base;

(c) a wire mechanism mounted on said mast mechanism having a pair of pulleys rotatable synchronously in opposite directions;

(d) a work platform supported on said wire guide mechanism;

(e) a pair of wires extending across said mast mechanism and having one ends fixed to said legs respectively at spaced positions thereon, said wires being wound around said pulleys, respectively; and (f) a pair of wire tensioners mounted on said legs respectively at spaced positions thereon for longitudinally tensioning said wires, respectively, in opposite directions, said wires extending substantially parallel to each other, said fixed ends of said wires being positioned symmetrically with respect to said mast mechanism, said wire tensioners being positioned symmetrically with respect to said mast mechanism.

2. An elevating apparatus comprising:

a substantially horizontal base;

a longitudinally extensible mast mechanism mounted vertically on said base;

a wire guide mechanism mounted on said mast mechanism and having a pair of pulleys rotatable synchronously in opposite directions, said wire guide mechanism comprising a casing interposed between said mast mechanism and a work platform, a pair of vertical and horizontal shafts mounted in said casing and extending in crisscross relation, a pair of first and second bevel gears rotatably mounted on said vertical shaft, and a pair of third and fourth bevel gears rotatably mounted on said horizontal shaft and held in mesh with both said first and second bevel gears, said pulleys being fixedly mounted on said third and fourth bevel gears, respectively;

said work platform supported on said wire guide mechanism;

a pair of wires extending across said mast having one ends fixed to said base respectively at spaced positions thereon, said wires being wound around said pulleys, respectively.

3. An elevating apparatus comprising:

(a) a substantially horizontal base, said base comprising two substantially crisscrossing pairs of horizontal pipes, said pipes and each pair extending in alignment with each other, and two pairs of legs telescopically fitted in said two pairs of pipes;

(b) a longitudinally extensible mast mechanism mounted vertically on said base;

(c) a wire guide mechanism mounted on said mast mechanism and having two pairs of pulleys, said pulleys in each pair being rotatable synchronously in opposite directions;

(d) a work platform supported on said wire guide mechanism;

(e) two pairs of wires extending across said mast mechanism, said wires in each pair having one ends fixed to said legs respectively at spaced positions thereon, said two pairs of wires being wound around said two pairs of pulleys, respectively; and (f) two pairs of wire tensioners mounted on said legs respectively at spaced positions thereon for longitudinally tensioning said wires, respectively, in opposite directions in each wire pair, said wires in each pair extending substantially parallel to each other, said fixed ends of said two pairs of wires being positioned at substantially equal angular intervals around said mast mechanism, said wire tensioners being positioned at substantially equal angular intervals around said mast mechanism.

4. An elevating apparatus comprising:

a substantially horizontal base;

a longitudinally extensible mast mechanism mounted vertically on said base;

a wire guide mechanism mounted on said mast mechanism and having two pairs of pulleys, said pulleys in each pair being rotatable synchronously in opposite directions, said wire guide mechanism comprising a casing interposed between said mast mechanism and a work platform, two pairs of vertical and horizontal shafts mounted in said casing, said vertical and horizontal shafts in each pair extending in crisscross relation, a pair of first and second bevel gears rotatably mounted on each said vertical shaft, and a pair of third and fourth gears rotatably mounted on each said horizontal shaft and held in mesh with both said first and second bevel gears, said pulleys in each pair being fixedly mounted on said third and fourth bevel gears, respectively;

and work platform supported on said wire guide mechanism; and a two pairs of wires extending across said mast mechanism, said wires in each pair having one ends fixed to said base respectively at spaced positions thereon, said two pairs of wires being wound around said two pairs of pulleys, respectively.

5. An elevating apparatus comprising:

(a) a substantially horizontal base including a pair of horizontal pipes extending in alignment with each other and a pair of legs telescopically fitted in said pipes remotely from each other;

(b) a longitudinally extensible mast mechanism mounted vertically on said base and horizontally between said horizontal pipes;

(c) a wire guide mechanism mounted on said mast mechanism and having a pair of parallel coaxial pulleys and means for synchronously rotating said coaxial pulleys in opposite directions;

(d) a work platform supported on said wire guide mechanism;

(e) a pair of parallel wires extending across said mast mechanism and having one ends fixed to said legs, respectively, of said base, said wires being wound around said pulleys, respectively; and (f) a pair of wire tensioners mounted on said legs, respectively, for longitudinally tensioning said wires, respectively, in opposite directions.

6. An elevating apparatus according to claim 5, wherein said wires have opposite ends connected to said wire tensioners, respectively, said fixed ends of said wires being positioned symmetrically with respect to said mast mechanism, said wire tensioners being positioned symmetrically with respect to said mast mechanism.

7. An elevating apparatus according to claim 5, wherein said wire guide mechanism comprises a casing interposed between said mast mechanism and said work platform, said means comprising a pair of vertical and horizontal shafts mounted in said casing and extending in crisscross relation, a pair of first and second bevel gears rotatably mounted on said vertical shaft, and a pair of third and fourth bevel gears rotatably mounted on said horizontal shaft and held in mesh with both said first and second bevel gears, said pulleys being fixedly mounted on said third and fourth bevel gears, respectively.

8. An elevating apparatus comprising:

(a) a substantially horizontal base including two substantially crisscrossing pairs of horizontal pipes, said pipes in each pair extending in alignment with each other, and two pairs of legs telescopically fitted in said two pairs of pipes remotely from each other;

(b) a longitudinally extensible mast mechanism mounted vertically on said base and horizontally between said horizontal pipes in each pair;

(c) a wire guide mechanism mounted on said mast mechanism and having two pairs of parallel coaxial pulleys and means for synchronously rotating said coaxial pulleys in each pair of opposite directions;

(d) a work platform supported on said wire guide mechanism;

(e) two pairs of parallel wires extending across said mast mechanism, said wires in each pair having one ends fixed to said legs, respecitvely, in each pair, said two pairs of wires being wound around said two pairs of pulleys, respectively; and (f) two pairs of wire tensioners mounted on said two pairs of legs, respectively, for longitudinally tensioning said wires, respectively, in opposite directions in each wire pair.

9. An elevating apparatus according to claim 8, wherein said wires have opposite ends connected to said wire tensioners, respectively, said fixed ends of said wires being positioned at substantially equal angular intervals around said mast mechanism, said wire tensioners being positioned at substantially equal angular intervals around said mast mechanism.

10. An elevating apparatus according to claim 8, wherein said wire guide mechanism comprises a casing interposed between said mast mechanism and said work platform, said means comprising two pairs of vertical and horizontal shafts mounted in said casing, said vertical and horizontal shafts in each Pair extending in crisscross relation, a pair of first and second bevel gears rotatably mounted on each said vertical shaft, and a pair of third and fourth bevel gears rotatably mounted on each said horizontal shaft and held in mesh with both said first and second bevel gears, said pulleys in each pair being fixedly mounted on said third and fourth bevel gears, respectively.

* * * * *